US007185829B2

(12) United States Patent
Sundholm

(10) Patent No.: US 7,185,829 B2
(45) Date of Patent: Mar. 6, 2007

(54) METHOD IN A SPRAY HEAD, AND SPRAY HEAD

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 178 days.

(21) Appl. No.: 10/485,376

(22) PCT Filed: Sep. 5, 2002

(86) PCT No.: PCT/FI02/00716

§ 371 (c)(1),
(2), (4) Date: Jun. 11, 2004

(87) PCT Pub. No.: WO03/022364

PCT Pub. Date: Mar. 20, 2003

(65) Prior Publication Data

US 2004/0251319 A1 Dec. 16, 2004

(30) Foreign Application Priority Data

Sep. 10, 2001 (FI) ..... 20011787

(51) Int. Cl.
*B05B 7/04* (2006.01)
*A62C 2/00* (2006.01)
*A62C 3/00* (2006.01)

(52) U.S. Cl. ..... 239/433; 239/8; 239/398; 169/43; 169/9

(58) Field of Classification Search ..... 239/433, 239/8, 398, 419, 406, 418, 416.5, 424.5, 239/425.5, 429; 169/43, 9, 15, 71, 91
See application file for complete search history.

(56) References Cited

U.S. PATENT DOCUMENTS 3,072,344 A * 1/1963 McKenzie ..... 239/433
4,989,675 A * 2/1991 Papavergos ..... 169/14
5,520,331 A 5/1996 Wolfe
6,223,827 B1 5/2001 Zuev et al.
6,318,474 B1 11/2001 Sundholm

FOREIGN PATENT DOCUMENTS

| | | |
|---|---|---|
| JP | 2000-288114 | 10/2000 |
| JP | 2002-017883 | 1/2002 |
| WO | 9801231 | 1/1998 |

OTHER PUBLICATIONS

English Abstract of WO 9801231 dated Jan. 15, 1998.
Patent Abstract of Japan of JP 2002-017883 dated Jan. 22, 2002.
Patent Abstract of Japan of JP 2000-288114 dated Oct. 17, 2000.

* cited by examiner

*Primary Examiner*—Kevin Shaver
*Assistant Examiner*—James S. Hogan
(74) *Attorney, Agent, or Firm*—Ladas and Parry LLP

(57) ABSTRACT

A method for producing a mist in a spray head (1), especially for fire-fighting purposes or for humidification of intake air, in which method a medium, preferably an extinguishing medium, is supplied under pressure into the chamber (2) of the spray head via an inlet (3) and through at least one first channel (4) into at least one nozzle (5), which comprises at least one channel zone (6) narrower in a direction transverse to the flow of medium and after that in the direction of flow of medium a channel space (7) wider in a direction transverse to the flow of medium than the narrow channel zone, from which wider channel space the mist of medium generated is passed out of the spray head via an outlet orifice (8). The mist of medium is influenced, at least by increasing its momentum and/or reducing its droplet size, by supplying into the channel space (7) at least one second medium, preferably a gas.

11 Claims, 2 Drawing Sheets

METHOD IN A SPRAY HEAD, AND SPRAY HEAD

BACKGROUND OF THE INVENTION

Figure 2:
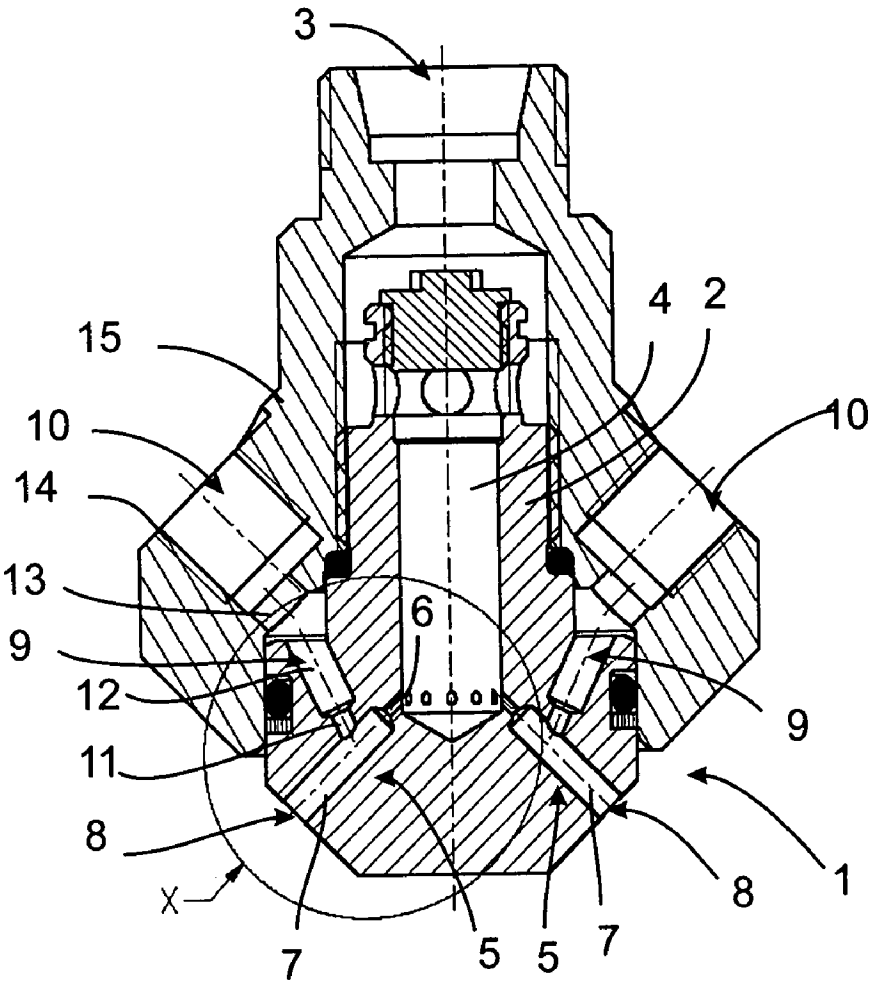

The present invention relates to a method for producing a mist in a spray head, especially for fire-fighting purposes or for humidification of intake air, in which method a medium, preferably an extinguishing medium, is supplied under pressure to the spray head via an inlet and through at least one first channel into at least one nozzle, which said nozzle comprises at least one channel zone narrower in a direction transverse to the flow of medium and after that in the direction of flow of medium a channel space wider in a direction transverse to the flow of medium than the narrow channel zone, from which wider channel space the mist of medium generated is passed out of the spray head via an outlet orifice.

The invention also relates to a spray head for producing a mist, preferably for fire-fighting purposes or for humidification of intake air, comprising an inlet and a fluid path from the inlet leading into at least one nozzle, said nozzle comprising at least one channel zone narrower in a direction transverse to the fluid path and after that in the direction of the fluid path a channel space wider in a direction transverse to the fluid path than the narrow channel zone, from which wider channel space the mist of medium generated is passed out of the spray head via an outlet orifice.

A spray head according to the subject of the invention is known from an international patent application under specification number WO 01/45799.

BRIEF DESCRIPTION OF THE INVENTION

The object of the present invention is to create a completely new type of solution in which the average droplet size and/or penetration of the mist to be sprayed can be easily adjusted and optimized for different applications.

The method of the invention is mainly characterized in that the mist of medium is influenced, at least by increasing its linear momentum and/or reducing its droplet size, by supplying into the channel space at least one second medium, preferably a gas.

The spray head of the invention is characterized in that the nozzle of the spray head is provided with at least one second channel for supplying a second medium into the wider channel space, causing it to mingle with mist at least partially formed in the channel space.

The solution of the invention has many significant advantages. By exerting an influence on the mist by supplying a second medium into the wider channel space, it is possible to significantly increase the momentum of the mist and thus to achieve a better penetration. On the other hand, with the solution of the invention, the droplet size of the mist can be substantially reduced without significantly impairing its penetration. Thirdly, the supply pressures of the mediums supplied need not be the same in comparison with each other. The nozzle of the invention has an unlimited adaptability by varying the liquid-gas ratio. In an extreme case, it is possible to supply the nozzle with liquid only, and in this case, too, mist is produced as a result. In addition to fire-fighting solutions, the solution of the invention can be used is numerous other applications. Thus, the nozzle solution can be used for humidification of intake air in various engines, such as diesel engines, or turbines.

SHORT DESCRIPTION OF ILLUSTRATIONS

Figure 1:
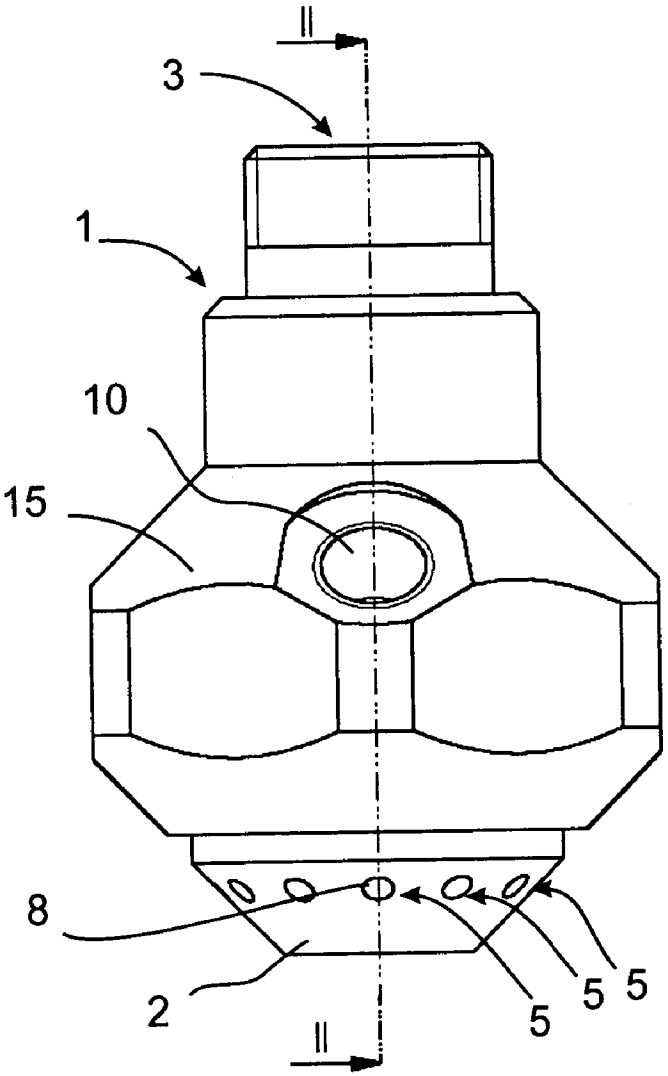
Figure 3:
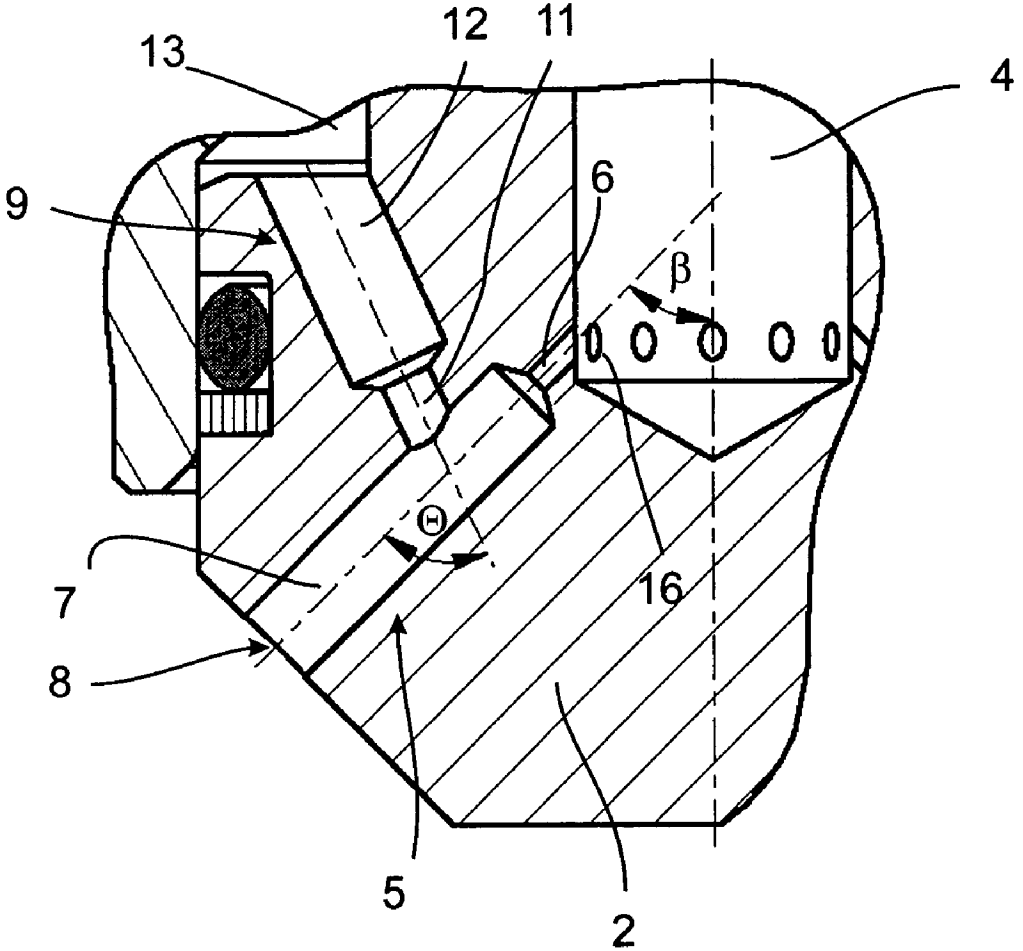

In the following, the invention will be described in detail by the aid of an example with reference to the attached drawings, wherein FIG. 1 presents a lateral view of a spray head according to the invention, FIG. 2 presents the spray head sectioned along line II—II in FIG. 1, and FIG. 3 presents a magnified detail X of the spray head in FIG. 2.

DETAILED DESCRIPTION OF THE INVENTION

FIGS. 1 and 2 present a spray head according to the invention. The spray head 1 comprises a chamber 2 with at least one inlet 3 for the supply of a medium, such as a hydrous extinguishing medium, into the spray head. From the inlet 3, the medium is passed via a fluid path comprising typically at least one first channel 4, such as a central channel, into at least one nozzle 5, preferably through at least one orifice 16. The nozzle 5 comprises in the direction of flow of the medium (in the direction of the fluid path) first a channel zone 6 that is narrower in at least one direction transverse to the direction of flow of the medium (to the direction of the fluid path), and after that a channel space 7 wider than the narrow channel zone, from which wider space the mist generated is passed out of the spray head 1 via the outlet 8 of the nozzle. The nozzle 5, which thus mainly consists of the narrower channel zone 6 and the wider channel space 7, is preferably disposed at an angle β relative to the first channel 4. The angle β typically has a magnitude between 0 and 90 degrees and preferably between 10–80 degrees, but it may even be as large as 120 degrees in some applications.

The spray head of the invention additionally comprises at least one second channel 9, which connects to the channel space 7 of the nozzle. The second channel 9 joins the channel space of the nozzle via a hole formed e.g. in a wall, preferably the side wall of the channel space 7. Into the second channel 9, a second medium, preferably a gas, can be supplied via at least one second inlet 10. In the embodiment shown in the figure, the second channel 9 comprises a narrower part 11, which connects the second channel to the channel space 7, and a second, wider channel part 12 as seen in the direction opposite to the direction of flow of the medium (or opposite to the direction of the second fluid path from the second inlet 10 to the channel space 7). The example in the figure comprises between the second channel 9 and the second inlet 10 a chamber space 13, which connects possible other second channels 9 to at least one second inlet 10. In the embodiment illustrated in the figures, the spray head comprises two second inlets 10.

In the example presented in the figures, the spray head 1 is provided with a plurality of nozzles 5, typically distributed in a successive arrangement around the central channel 4, preferably diverged relative to each other.

The channels 7, 9 of the nozzles are typically manufactured by machining, preferably by drilling, so that they have a circular form in perpendicular cross-section. Thus, the channel space 7 of the nozzle is preferably mainly cylindrical. Naturally it is also possible to use other suitable geometries.

FIG. 3 presents magnified view of a nozzle 5 in the spray head presented in FIG. 2.

The second channel 9 forms an angle θ with the direction of flow in the channel space 7 of the nozzle. The angle θ is typically between 10 and 90 degrees, preferably between 20- and 80 degrees. In some cases, the angle θ may even exceed 90 degrees.

The second channel 9 for a medium is typically connected to a pressurized piping system used to supply a second medium into the spray head. The second medium is passed into the second medium channel 9 via the second intake 10, which can be provided with a coupling sleeve, mounted e.g. on threads 14 provided in the inlet 10, for connection to the pressurized piping. The second medium is preferably a gas. The gas is typically an inert gas, air or e.g. nitrogen. The gas may naturally also consist of a gas mixture. The gas is preferably a non-combustible gas. The gas is supplied via the inlet 10 into the second channel under pressure, e.g. from a pressure tank, such as a gas cylinder, or e.g. by means of a compressor. By supplying a gas under pressure into the channel space 7 of the nozzle, the mist produced is subjected to a pressure effect, which on the one hand reduces the droplet size and/or increases the momentum of the droplets. As a result of this, the penetration of the mist produced is increased, and thus a solution very efficient in fire extinguishing is achieved.

The spray head embodiment presented in the figures comprises a main chamber 2, which is at least partially disposed in an external frame 15. The external frame is provided with an inlet orifice 3 for a first medium and at least one second inlet orifice 10 for a second medium. The chamber 2 is so disposed in the external frame 15 that a fluid path or a passage exists from inlet orifice 3 via the central channel 4 to the nozzles 5 and a second fluid path or a passage for the second medium from the second inlet orifice 10 via the second channel 9 into the channel space 7 of the nozzle. Between the external frame and the chamber, a preferably ring-like chamber space 13 is formed to connect the second channels 9 to at least one second inlet orifice 10.

The invention thus concerns a method for producing a mist, especially a liquid mist in a spray head 1, in particular for fire-fighting purposes. In the method of the invention, a medium, preferably an extinguishing medium, is supplied via the inlet 3 into the chamber 2 of the spray head under a high pressure and through the channel 4 into at least one nozzle 5. The nozzle comprises at least one channel zone 6 narrower in a direction transverse to the flow of the medium and after that in the direction of flow of the medium a channel space 7 wider than the narrow channel zone in a direction transverse to the flow of the medium, from which wider space the mist of medium generated is passed out of the spray head via an outlet port 8. In the channel space 7 of the nozzle, an influence is exerted on the mist of medium, at least by increasing its momentum and/or reducing its droplet size, by supplying into the channel space 7 at least one second medium, preferably a gas. According to a preferred embodiment of the method, at least one second medium is supplied into the channel space via at least one second channel 9. The first medium typically mainly consists of a liquid, such as water, or a mixture of a liquid and a gas. In a fire extinguishing solution, the medium typically consists of a hydrous extinguishing medium. The first flow of medium is preferably deflected before it is passed into the nozzle 5. The flow of medium is typically deflected by an angle β. The deflection allows more effective generation of mist.

The second medium is preferably a gas, which is supplied under pressure into the channel space 7. The gas may be an inert gas, air or e.g. nitrogen. The gas may also be a gas mixture. The extinguishing medium used is typically a liquid, preferably water, in which case water mist is produced. The line pressures used in the method may vary according to the embodiment. The pressure of the first medium is typically 10–300 bar, preferably over 50 bar. By varying the pressure of the second medium, it is possible to influence the properties of the mist produced by the nozzle. The nozzle solution of the invention is a so-called self-suction type, which means that the spraying of the second medium in the nozzle produces a suction in the second channel 9. The nozzle of the invention will continue working fully satisfactorily even if the supply pressure of the second medium should have fallen to a minimum.

It is obvious to the person skilled in the art that the invention is not limited to the embodiments described above, but that it may be varied within the scope of the following claims.

The invention claimed is:

1. In a method for producing a first mist from a spray head (1) having a first medium supplied under pressure in a flow direction through at least one first channel (4) into at least one channel zone (6) narrower in a direction transverse to the flow direction than the first channel (4) and then into a channel space (7) wider in a direction transverse to the flow of medium than the channel zone to provide a second mist of the first medium, the improvements comprising:

influencing the second mist by at least one of increasing a linear momentum or reducing a droplet size, thereof by supplying into the channel space (7) at least one second medium to provide the first mist, characterized in that the second medium is a gas supplied under pressure into the channel space (7) and in that the flow of the first medium is deflected between the first channel (4) and the at least one channel zone (6).

2. Method according to claim 1, characterized in that said at least one second medium is supplied into the channel space (7) via at least one second channel (9).

3. Method according to claim 1, characterized in that the first medium is a liquid, water, or a mixture of a liquid and a gas.

4. Method according to claim 1, characterized in that the second medium is a gas supplied under pressure into the channel space (7).

5. Method according to claim 1, characterized in that the flow direction of the first medium is deflected between the first channel (4) and the at least one channel zone (6).

6. Method according to claim 1, characterized in that the supplying of the second medium into the channel space (7) is at an angle (θ).

7. Method according to claim 1, wherein the first medium is a fire extinguishing medium.

8. In a spray head (1) providing a second mist for producing a first mist, the spray head comprising a first channel (4) starting a fluid path for a first medium to flow first to at least one channel zone (6) that is narrower in a direction transverse to the fluid path than the first channel and and then to a channel space (7) that is wider in a direction transverse to the fluid path than the channel zone for providing the second mist, the improvements characterized by at least one second channel (9) for supplying a second medium into the channel space (7) for bringing the second medium into contact with the second mist to form the first mist in the channel space, and characterized in that the fluid path of the spray head comprises a nozzle (5) fitted at an angle (β) relative to the at least one first channel (4) so that the flow of first medium in the channel zone (6) is at an angle (β) to the flow of the first medium in the first channel (4).

9. Spray head according to claim 8, characterized in that the spray head (1) comprises a plurality of said nozzles (5).

10. Spray head according to claim 8, characterized in that the second channel (9) is disposed at an angle (θ) relative to the channel space (7).

11. Spray head according to claim 8, characterized in that the second channel (9) is connected to a pressure piping system.

* * * * *